US009695688B2

(12) United States Patent
Wachsmann et al.

(10) Patent No.: US 9,695,688 B2
(45) Date of Patent: Jul. 4, 2017

(54) ROUND-SHAFT CHISEL ARRANGEMENT, A RETAINING RING FOR A ROUND-SHAFT CHISEL ARRANGEMENT, A SET WITH A CLAMPING SLEEVE AND A RETAINING RING, AND A METHOD FOR SECURING A ROUND-SHAFT CHISEL IN A TOOL HOLDER

(71) Applicant: BOMAG GmbH, Boppard (DE)

(72) Inventors: Steffen Wachsmann, Koblenz (DE); Monica Wolf, Neuwied (DE)

(73) Assignee: BOMAG GmbH, Boppard (DE)

( * ) Notice: Subject to any disclaimer, the term of this patent is extended or adjusted under 35 U.S.C. 154(b) by 79 days.

(21) Appl. No.: 14/642,783

(22) Filed: Mar. 10, 2015

(65) Prior Publication Data

US 2015/0252670 A1 Sep. 10, 2015

(30) Foreign Application Priority Data

Mar. 10, 2014 (DE) ..... 10 2014 004 339

(51) Int. Cl.
*E21C 35/197* (2006.01)
*E01C 23/088* (2006.01)
*E01C 23/12* (2006.01)

(52) U.S. Cl.
CPC ..... *E21C 35/197* (2013.01); *E01C 23/088* (2013.01); *E01C 23/127* (2013.01)

(58) Field of Classification Search
CPC ..... E21C 35/197; E21C 35/19; E01C 23/127
See application file for complete search history.

(56) References Cited

U.S. PATENT DOCUMENTS 3,499,685 A * 3/1970 Kniff ..... E21C 35/197 299/104
3,519,309 A * 7/1970 Engle ..... E21C 35/183 175/354
3,752,515 A * 8/1973 Oaks ..... E21C 35/197 299/109

(Continued)

FOREIGN PATENT DOCUMENTS

AT 004193 U1 3/2001
DE 102005001535 B3 8/2006

(Continued)

OTHER PUBLICATIONS

ESPACENET, English Machine Translation of AT004193U1, published Mar. 26, 2001, retrieved from http://worldwide.espacenet.com on Mar. 8, 2015 (8 pages).
ESPACENET, English Machine Translation of DE102005001535B3, published Aug. 31, 2006, retrieved from http://worldwide.espacenet.com on Mar. 8, 2015 (16 pages).

(Continued)

*Primary Examiner* — John Kreck
*Assistant Examiner* — Michael Goodwin
(74) *Attorney, Agent, or Firm* — Wood Herron & Evans LLP

(57) ABSTRACT

The present invention relates to a round-shaft chisel arrangement with a chisel, comprising a chisel shaft and a chisel tip, a clamping sleeve and a retaining ring. The present invention further relates to a retaining ring for such a round-shaft chisel arrangement and a set comprising a clamping sleeve and a retaining ring. A further aspect of the present invention relates to a method for securing a round-shaft chisel against axial displacement in a chisel retainer.

8 Claims, 3 Drawing Sheets

(56) References Cited

U.S. PATENT DOCUMENTS

| | | | | | |
|---|---|---|---|---|---|
| 4,316,636 | A * | 2/1982 | Taylor | E21C 35/197 | 175/413 |
| 4,327,947 | A * | 5/1982 | Bower, Jr. | E21C 35/197 | 279/19.7 |
| 5,370,448 | A * | 12/1994 | Sterwerf, Jr. | E21C 35/197 | 175/413 |
| 5,415,462 | A * | 5/1995 | Massa | E21C 35/197 | 299/106 |
| 6,478,383 | B1 * | 11/2002 | Ojanen | E21C 35/18 | 299/104 |
| 2005/0146198 | A1 * | 7/2005 | Hill | E21C 35/197 | 299/76 |
| 2009/0162159 | A1 | 6/2009 | Kammerer et al. | | |

FOREIGN PATENT DOCUMENTS

| | | | |
|---|---|---|---|
| DE | 102005051450 | A1 | 5/2007 |
| DE | 20 2006 020 765 | U1 | 1/2010 |
| DE | 10 2010 014 529 | A1 | 10/2011 |
| DE | 10 2010 014 904 | A1 | 10/2011 |
| DE | 10 2010 044 649 | A1 | 3/2012 |
| DE | 10 2010 051 048 | A1 | 5/2012 |
| DE | 10 2011 114 185 | A1 | 3/2013 |
| DE | 10 2011 054 386 | A1 | 4/2013 |
| DE | 10 2012 216 262 | B3 | 10/2013 |

OTHER PUBLICATIONS

ESPACENET, English Machine Translation of DE202006020765U1, published Dec. 10, 2009, retrieved from http://worldwide.espacenet.com on Mar. 9, 2015 (8 pages).

ESPACENET, English Machine Translation of DE102010014529A1, published Oct. 13, 2011, retrieved from http://worldwide.espacenet.com on Mar. 9, 2015 (11 pages).

ESPACENET, English Machine Translation of DE102010014904A1, published Oct. 20, 2011, retrieved from http://worldwide.espacenet.com on Mar. 9, 2015 (16 pages).

ESPACENET, English Machine Translation of DE102010044649A1, published Mar. 8, 2012, retrieved from http://worldwide.espacenet.com on Mar. 9, 2015 (18 pages).

ESPACENET, English Machine Translation of DE102010051048A1, published May 16, 2012, retrieved from http://worldwide.espacenet.com on Mar. 9, 2015 (18 pages).

ESPACENET, English Machine Translation of DE102011114185A1, published Mar. 28, 2013, retrieved from http://worldwide.espacenet.com on Mar. 9, 2015 (19 pages).

ESPACENET, English Machine Translation of DE102011054386A1, published Apr. 11, 2013, retrieved from http://worldwide.espacenet.com on Mar. 9, 2015 (9 pages).

ESPACENET, English Machine Translation of DE102012216262B3, published Oct. 17, 2013, retrieved from http://worldwide.espacenet.com on Mar. 9, 2015 (12 pages).

* cited by examiner

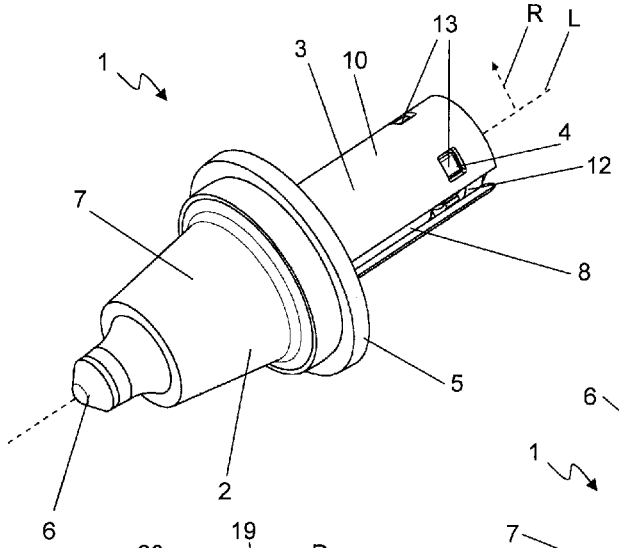
Fig. 1
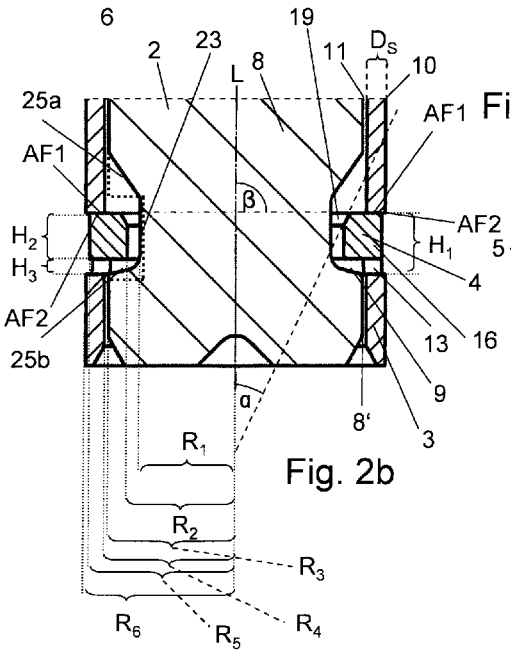
Fig. 2a
Fig. 2b
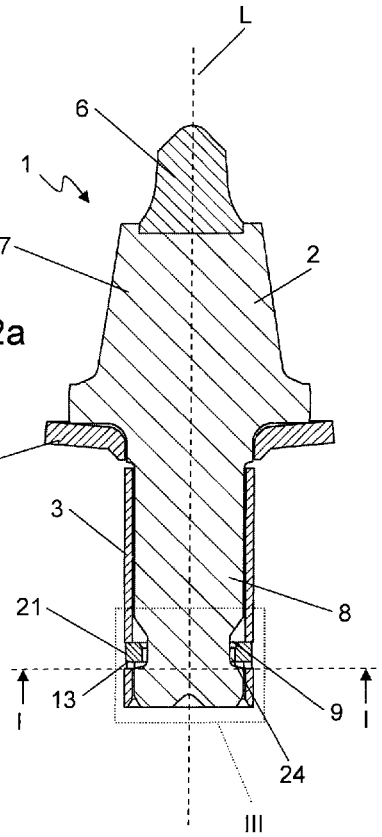

Fig. 3
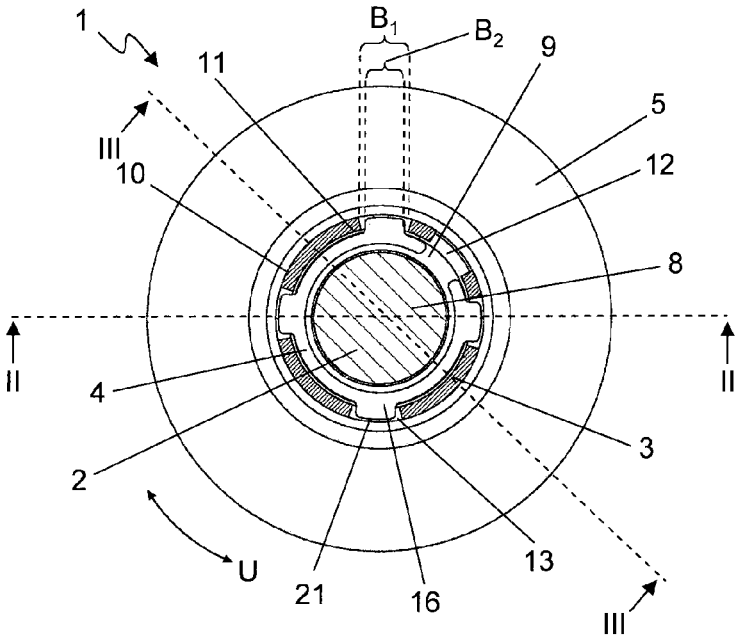
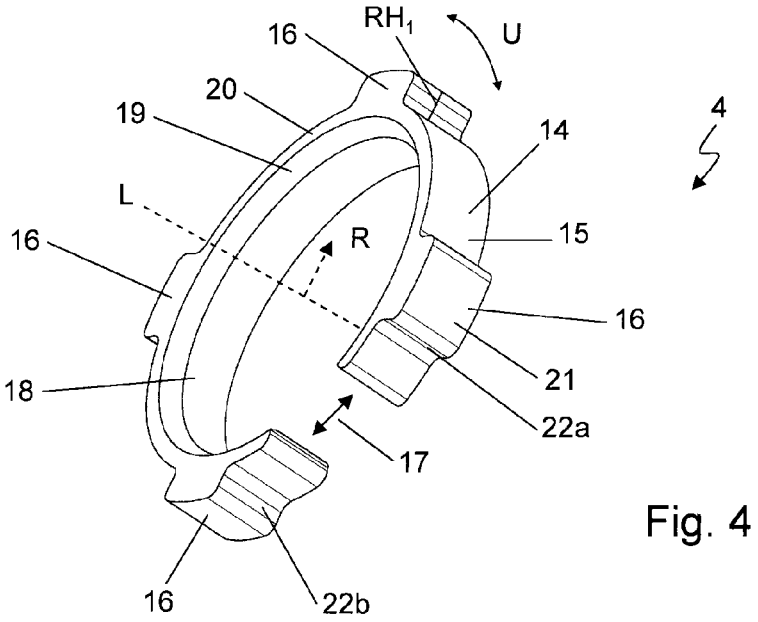
Fig. 4

Fig. 5
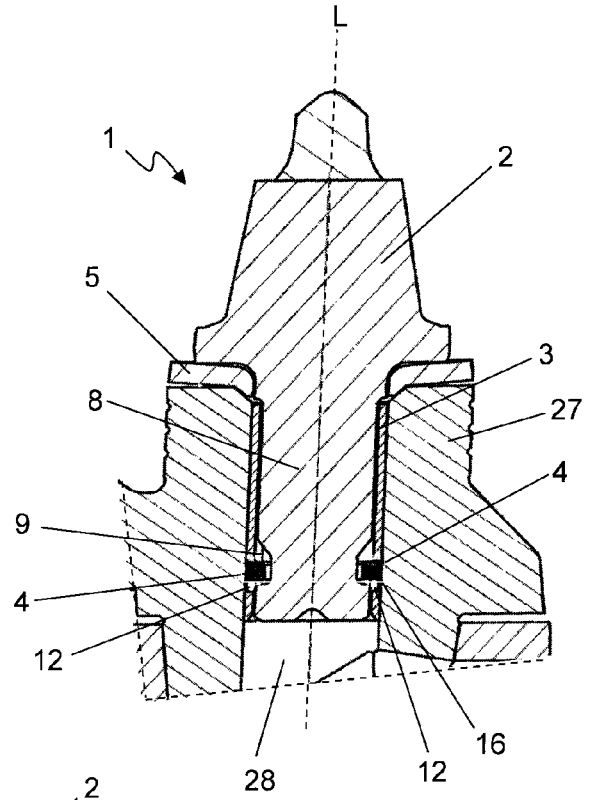
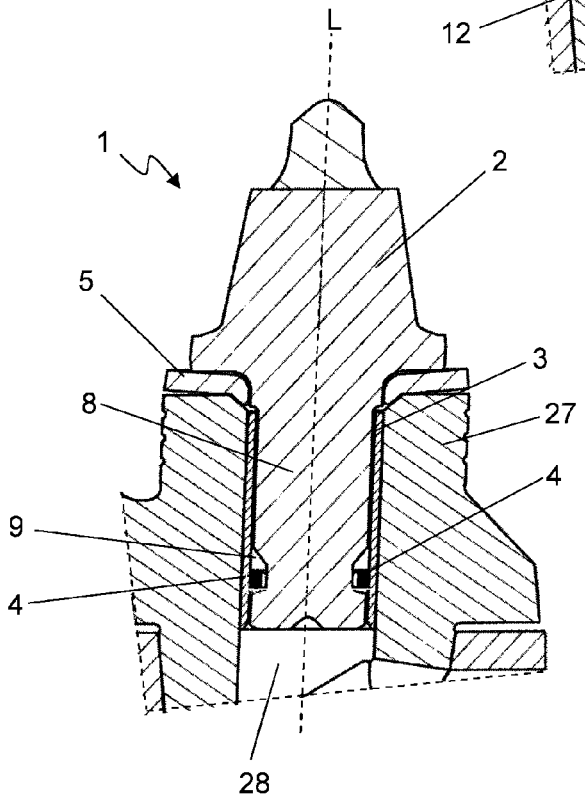
Fig. 6

ROUND-SHAFT CHISEL ARRANGEMENT, A RETAINING RING FOR A ROUND-SHAFT CHISEL ARRANGEMENT, A SET WITH A CLAMPING SLEEVE AND A RETAINING RING, AND A METHOD FOR SECURING A ROUND-SHAFT CHISEL IN A TOOL HOLDER

CROSS-REFERENCE TO RELATED APPLICATIONS

The present application claims priority under 35 U.S.C. §119 of German Patent Application No. 10 2012 024 221.2, filed Dec. 11, 2012, the disclosure of which is hereby incorporated herein by reference in its entirety.

FIELD OF THE INVENTION

The present invention relates to a round-shaft chisel arrangement, a retaining ring for a round-shaft chisel arrangement, a set for securing a chisel in a chisel holder with a clamping sleeve and a retaining ring, and a method for securing a round-shaft chisel in a chisel holder.

BACKGROUND OF THE INVENTION

Typical fields of application of generic round-shaft chisel arrangements are especially the equipment of milling drums for cold milling machines, recyclers and surface miners. Such machines are known, for example, from the specifications DE 10 2011 114 185 A1 and DE 10 2010 014 529 A1 for a cold milling machine, from DE 10 2010 014 904 A1 for a recycler, and DE 10 2012 216 262 B3 for a surface miner. Essential elements in such a round-shaft chisel arrangement are a chisel with a cylindrical chisel shaft extending along the longitudinal axis and a chisel tip which represents the working tool of the chisel. The chisel tip is connected to the chisel shaft, especially in a direct fashion. The chisel tip frequently further comprises respective hard-metal tips or comparable devices in order to further increase the wear resistance of the chisel. In working operation, such chisels are inserted into suitable chisel holders which produce a connection between the chisel and the milling drum. Such chisel holders are described, for example, in the specifications DE 10 2010 051 048 A1 and DE 10 2010 044 649 A1, to which reference is made hereby. The used chisel holders usually have a base region with which the chisel holder is connected to the supporting tube of the milling drum. The chisel holder further comprises a retaining recess, which is especially shaped like a hollow cylinder at least in relevant parts, and into which the round-shaft chisel protrudes with its chisel shaft and in which it is retained during the working process. A device for the releasable fixing of a round-shaft chisel in a chisel bushing with a fixing ring with a circumferential rib engaging in a circumferential annular groove is known from AT 004 193 U1.

It is necessary for a reliable working process that the positioning of the chisel, especially in the axial direction of the chisel shaft, in the chisel holder or within its retaining recess is ensured. A so-called clamping sleeve is frequently used in the prior art, which in the delivery state is pretensioned, e.g., by means of a wear disc which is provided to enclose the chisel shaft. If the entirety of the chisel and the clamping sleeve is seated in the chisel holder, the clamping sleeve is relaxed and rests at least in sections on the inner jacket surface of the receiving borehole in the chisel holder for the round-shaft chisel. In working operation of the round-shaft chisels, it is now provided that the round-shaft chisel is rotatably accommodated in the retainer of the chisel holder in order to enable constant, rotational-symmetric wear and tear of the chisel. In order to ensure the rotatability of the chisel around the longitudinal axis of the round-shaft chisel and to simultaneously ensure axial securing of the round-shaft chisel in the clamping sleeve, the clamping sleeve comprises punched-out retaining tabs which engage in a radially inwardly directed fashion in a retaining groove (retaining bead) surrounding the circumference of the chisel shaft. Such an arrangement is known from DE 20 2006 020 765 U1, for example. As a result, the round-shaft chisel is secured in its axial position against displacement by the retaining tabs engaging in the retaining groove on the one hand. On the other hand, a rotational bearing for the round-shaft chisel is obtained, so that it is able to rotate in the retainer about its longitudinal axis. In practical operation of such an arrangement, it has been noticed, however, that it is relatively susceptible to the penetration of considerable quantities of milled material mixed with water, as a result of which the rotatability and thus uniform wear and tear of the round-shaft chisel are impaired. This is especially the case when a kind of interlocking connection is achieved between the clamping sleeve and the round-shaft chisel by the introduced milling material, so that the rotatability of the round-shaft chisel thus ceases completely.

An alternative to the aforementioned known clamping sleeves is disclosed, for example, in DE 10 2011 054 386 A1, in which a short, spring-elastic ring is present which is carried by a groove in the chisel shaft, and which comprises several fastening sections distributed over its circumference, which in the clamped state rest either directly on the smooth surface of the chisel holder borehole or in a respective bead. This arrangement partly provides unsatisfactory retaining results of the round-shaft chisel in the respective receiving borehole and the rotational behaviour of the chisel is thus frequently not ensured in the desired manner. Furthermore, considerable quantities of milled material can penetrate the intermediate space between the chisel shaft and the inner wall of the retaining recess.

SUMMARY OF THE INVENTION

Based on the present prior art, it is thus the object of the present invention to provide possibilities to enable improved rotational behaviour of the chisel in a round-shaft chisel arrangement during the working process and to simultaneously prevent or at least reduce the clogging of the intermediate space, in particular, between the chisel shaft and the sleeve and/or the inner wall of the retaining recess by milled material.

This object is achieved by a round-shaft chisel arrangement, a retaining ring for a round-shaft chisel arrangement, a set comprising a retaining ring and a clamping sleeve, and a method for securing a round-shaft chisel in a chisel holder.

The present invention is achieved in a first aspect by a round-shaft chisel arrangement, comprising a chisel with a chisel shaft and a chisel tip, wherein a retaining groove, especially an annular groove, is present in the chisel shaft, which retaining groove surrounds the circumference of the chisel shaft. The round-shaft chisel arrangement further comprises a clamping sleeve which surrounds the chisel shaft at least in part. The clamping sleeve, which is arranged in a substantially hollow-cylindrical shape, for example, usually has a cross-section shaped in the manner of a circular ring segment transversely to the longitudinal axis, especially at least with a circumferential range of 0° to 270°, and particularly at least 0° to 310°. Tensioning and tensioning relief of the clamping sleeve is possible in the manner known from the state of the art as a result of the provided segment recess along the longitudinal axis of the clamping sleeve, for example, which segment recess is especially shaped in the manner of a slit. It is finally also provided in accordance with the present invention that the round-shaft chisel arrangement comprises a retaining ring as a further element, which is arranged at least partly in the retaining groove of the chisel shaft and partly engages around the chisel shaft within the retaining groove. The retaining ring also has a substantially hollow-cylindrical arrangement with a circular segment profile in a plane perpendicular to the cylinder axis at least with respect to its inner jacket surface, and, also, especially running around at least in a circumferential range of 0° to 270°, and especially at least 0° to 310°. A further relevant element of the retaining ring are at least two retaining projections which protrude or are oriented radially (in relation to the cylinder axis) towards the outside. The retaining projections thus protrude in the manner of a finger or a lug in the radial direction towards the outside from a circular-ring segment base body of the retaining ring. The at least two retaining projections thus protrude separate from each other in the radial direction in accordance with the present invention and do not completely surround the circular-ring segment base body of the retaining ring and are thus solely connected to each other via the circular-ring segment base body. As a result of this embodiment, segments as a portion of the retaining ring are obtained which are arranged in the manner of star-shaped protruding retaining teeth, so that the retaining ring comprises depressions and elevations on its outside jacket surface which alternate circumferentially in the radial direction. Although the total number of provided retaining projections can vary in principle, the use of a total of 3 to 10, and especially 3 to 5, retaining projections per retaining ring has proven to be preferable in practical operation.

A central aspect of the present invention is that the retaining projections are dimensioned in the manner that they protrude radially beyond the outside circumferential surface of the chisel shaft and engage in corresponding recesses (cuts and openings, respectively) in the clamping sleeve. The retaining projections are thus dimensioned in the radial direction to such an extent that when the retaining ring is inserted in the retaining groove they will protrude with their face ends facing to the outside in the radial direction beyond the outer circumferential surface of the chisel shaft as seen in the axial direction of the longitudinal axis of the round-shaft chisel. A type of hook element is thus obtained with the retaining projections in cooperation with the round-shaft chisel, which hook element is used for axially securing the round-shaft chisel in a manner which will be explained below in closer detail. Respective recesses are provided in the clamping sleeve, which recesses are formed for accommodating at least a partial region of the respective retaining projections. The distribution of the retaining projections in the retaining ring is thus complementary to the distribution of the recesses in the clamping sleeve with respect to the circumferential angle. The retaining ring thus ensures that the round-shaft chisel, in the case of its existing engagement with its retaining projections in the recesses, is secured with respect to the clamping sleeve in the axial direction and can be moved only to a very limited extent, if at all. At the same time, the round-shaft chisel remains rotatable with respect to the clamping sleeve. The arrangement of the retaining ring in the retaining groove surrounding the chisel shaft allows rotatability of the retaining ring and thus the clamping sleeve with respect to the chisel shaft.

The configuration of the clamping sleeve is thus generally simplified on the one hand because the production of respective retaining tabs for engagement in a retaining groove in the chisel is no longer necessary. It is merely necessary to introduce pass-through openings (recesses) for the later engagement of the retaining projections. On the other hand, the required freedom of movement of the clamping sleeve with respect to the round-shaft chisel is reduced, as a result of which the free space between the inner jacket surface of the clamping sleeve and the chisel shaft of the round-shaft chisel is reduced for the round-shaft chisel arrangement clamped in a suitable holder. As a result, the space in which milled material can potentially accumulate and can frequently lead to an interlocking engagement between the milled material and the punched holding tabs is minimised, thus, consequently, improving the rotational behaviour of the chisel. At the same time, mounting and/or dismounting tools known from the prior art can be used because the arrangement in accordance with the present invention has no influence on the insertion and extraction process of the round-shaft chisel arrangement in a suitable chisel holder.

With respect to its principal configuration, the retaining ring preferably has an annular base body, which is referred to below as the annular body or circular-ring segment base body, and on which the at least two retaining projections are arranged in a distributed manner to protrude from its outside circumference in the radial (outside) direction, wherein the annular body is arranged in the manner that with its outside jacket surface it does not protrude beyond the outside jacket surface of the chisel shaft. The annular body of the retaining ring is further ideally arranged so as to not completely surround its cylinder axis, and rather comprises a clamping breakthrough in the circumferential direction which facilitates the compressing and pressing apart of the retaining ring, e.g., during the insertion and subsequent latching of the retaining projections in the recesses of the clamping sleeve. The annular body is thus preferably a circular-ring segment base body, wherein it is preferably circumferential about its ring axis in a range of greater than 270° and especially greater 310°. The retaining projections protrude outwardly in the radial directions preferably in constant angular distances and are arranged spaced from each other on the annular body in the circumferential direction of the annular body, ideally evenly spaced from each other. The annular body and the retaining projections are ideally arranged in an integral fashion and are made of the same material. The annular body comprises an outside jacket which is interrupted by the retaining projections in the circumferential direction. With respect to the overall appearance of the retaining ring, reference is thus also made below to an inner jacket surface, an outer jacket surface which is inwardly offset to the back in the radial direction and which is formed by the annular body, and an outer jacket surface which is situated on the outside in the radial direction and which is formed by the radial outer face ends of the retaining projections. Only the engagement of the retaining projections in the respective recesses in the clamping sleeve is necessary for axially securing the chisel. In order to ensure the engagement of the retaining projections in the respective recesses in the clamping sleeve in a manner where the engagement is as constant as possible over the circumference, it is now provided that the inwardly facing outer jacket surface of the retaining ring is dimensioned in such a way that it does not project beyond the outer jacket surface of the chisel shaft. The inwardly disposed outer jacket surface thus lies within the retaining groove and does not protrude in the radial direction beyond the outer jacket surface of the chisel shaft. In other words, the retaining ring exclusively protrudes with its retaining projections beyond the outside jacket surface of the chisel shaft in the radial direction. This ensures that contact with the clamping sleeve by the retaining ring only occurs by way of its retaining projections and not by way of its annular body, thus simplifying mounting and dismounting.

The retaining ring is dimensioned in such a way that it does not rest on the base of the retaining groove in the chisel shaft in the radial direction towards the inside, but rather comprises play in this direction with respect to the base of the groove. The base of the groove is the jacket surface of the retaining groove which is offset in the radial direction towards the longitudinal axis. The inner diameter of the retaining ring is thus preferably greater by a factor 1.01, and especially greater by 1.05, than the diameter of the outside jacket surface of the base of the groove, thus ensuring that the retaining ring is rotatable with respect to the round-shaft chisel about the longitudinal axis.

It is especially necessary for mounting the retaining ring on the round-shaft chisel that the retaining ring has elastic properties at least to a certain extent. It therefore preferably consists of an elastic material, especially suitable spring steel. Reference is hereby made, by way of example, to the respective information provided in DIN EN 10089 and DIN EN 10132-1 and DIN EN 10132-2. The clamping sleeve also preferably consists of such spring steel. The clamping sleeve and the retaining ring are made of the same material in an especially preferable way.

It is principally sufficient for axially securing the round-shaft chisel in the clamping sleeve when the retaining projections enter the recesses in any form. The recesses in the clamping sleeve are, therefore, arranged as pass-through openings in accordance with one embodiment of the present invention, i.e., the recesses travel through the clamping sleeve and are therefore arranged in an open manner towards the outside and the inside. As a result, the entire thickness of the clamping sleeve is available in the radial direction for supporting the respective retaining projections of the retaining ring or for their limit stop. Furthermore, respective pass-through openings can be produced in a relatively simple way.

The retaining ring and the clamping sleeve are ideally dimensioned with respect to each other in such a way that the entire round-shaft chisel arrangement in the retainer of a chisel holder is achieved virtually exclusively by frictional engagement of the clamping sleeve against the respective receiving opening in the retainer. The radial extension of the retaining projections is thus preferably dimensioned in such a way that they substantially do not project beyond the outer jacket surface of the clamping sleeve in engagement in the recesses of the clamping sleeve in the radial direction. In other words, the retaining projections thus preferably end with their face ends within the thickness of the clamping sleeve in the radial direction and do not overlap them to the outside. The diameter of the outer jacket surfaces is thus smaller than the diameter of the receiving opening of the chisel holder. This also ensures, for example, that the round-shaft chisel arrangement is not directly supported with the retaining projections in relation to the retainer, which is advantageous with respect to mounting, for example.

Retaining rings which are suitable for the round-shaft chisel arrangement in accordance with the present invention can be obtained in an especially simple way when the thickness of the retaining projections in the axial direction corresponds to the thickness of the annular body. In other words, the retaining projections and the annular body of the retaining ring have the same thickness in the axial direction, thus considerably simplifying the production of the retaining ring so that it can be obtained, for example, via a punching process.

The retaining ring preferably comprises a bevel towards its inner jacket surface. This facilitates simple mounting of the retaining ring on the chisel shaft. The bevel is ideally arranged as a chamfer of a face end of the retaining ring in the axial direction towards the inner jacket surface of the annular body. The surface of the bevel thus has the shape of a conic section. It is understood that a double bevel can also be provided, so that the retaining ring is arranged in a tapering manner with respect to its thickness from its two face ends to the inner jacket surface.

In order to facilitate mounting and to simultaneously enable a sufficient measure of mobility of the round-shaft chisel relative to the clamping sleeve, the recesses in the clamping sleeve in the axial direction and/or in the circumferential direction are preferably dimensioned in such a way that the engaging retaining projections are provided with play with respect to the recesses. In other words, the recesses are preferably slightly larger in the axial direction and/or the circumferential direction than would be necessary for pure engagement of the retaining projections. The recesses in the axial direction and/or the circumferential direction are preferably arranged greater by a factor of 1.05, especially greater by a factor of 1.1, and especially greater by a factor of 1.2. This ensures that the retaining projections in the recesses do not engage in the axial direction and/or in the circumferential direction in a rigid and flush manner and thus becomes skewed, for example. This especially facilitates the handling of production tolerances and improves the mounting ability of the round-shaft chisel arrangement.

The retaining projections thus strike in the axial direction of the round-shaft chisel the inner edge of the pass-through openings, so that an interlocking engagement is achieved between these two elements, thus preventing a longitudinal displacement of the retaining projections, and thus of the retaining ring and the round-shaft chisel along the longitudinal axis. It is preferable, in this respect, if the respective stop surfaces on the retaining projections and/or the pass-through openings in the clamping sleeve extend substantially perpendicularly to the longitudinal axis, at the very least at an angle of greater 80° in relation to the longitudinal axis of the round-shaft chisel. It is thus securely prevented that even under strong loads, the retaining projections do not act as sliding bevels in the axial direction and do not press the retaining projections out of the pass-through openings.

The retaining groove in the chisel shaft is preferably an annular recess in the chisel shaft, which recess extends from the outer circumferential surface in the direction of the longitudinal axis or rotational axis of the chisel, wherein the chisel shaft per se is ideally arranged substantially in the shape of a cylindrical body. Relevant elements of the retaining groove are a groove base and two groove walls which protrude at least partly in the radial direction from the groove base. The wall, which is the front one in the axial direction towards the tip of the round-shift chisel, is designated as the front wall, and the wall which is accordingly the rear one in the axial direction towards the tip, is designated as the rear wall of the retaining groove. The front wall and the rear wall can principally extend perpendicularly to the groove base, wherein it is especially preferred if the rear groove wall (rear wall) extends perpendicularly to the groove base and substantially straight in the radial direction. This ensures reliable positioning of the retaining ring in the axial direction, in particular, towards the rear side of the round-shaft chisel and high axial forces can be transmitted reliably during the extraction of the chisel and/or during milling. The front wall also extends preferably perpendicularly to groove base and substantially straight in the radial direction. Both groove walls can also comprise a slight oblique positioning which is caused by production, for example, and can jointly form a funnel-shaped cross-sectional profile, for example.

A further aspect of the present invention lies in a retaining ring for a round-shaft chisel arrangement according to one of the preceding embodiments. Reference is hereby made to the aforementioned statements concerning the specific arrangement and configuration of the retaining ring. A relevant feature of the retaining ring in accordance with the present invention is its arrangement comprising an annular base body (with clamping recess) with retaining projections which protrude radially to the outside and are arranged in an alternating manner. They are preferably dimensioned in such a way that the exterior outer jacket surface of the retaining ring (according to the outer face ends of the at least two retaining projections) corresponds with respect to its radius to 1.1 to 1.5 times the radius of the interior outer jacket surface of the annular body of the retaining ring. With respect to their circumferential width, the retaining projections preferably have a width in the range of 10° to 60° and especially 20° to 30°. The total number of the retaining projections can also vary. The total number of the retaining projections preferably lies in the range of three to ten and especially three to five. The retaining projections are further preferably arranged in an evenly distributed manner over the circumference of the retaining ring. In other words, they are ideally provided with the same angular distance from each other.

A further fundamental idea of the present invention relates to a set, comprising a retaining ring according to the preceding embodiments and a clamping sleeve with recesses which are arranged for engagement of the retaining projections of the retaining ring. This set is especially provided for a round-shaft chisel arrangement according to the preceding embodiments and reference is made to the statements made above concerning the configuration details of the retaining ring and the clamping ring. A relevant criterion of said set, in accordance with one embodiment of the present invention, is that the clamping sleeve and the retaining ring are arranged with respect to each other in the manner that the retaining ring engages with its retaining projections in the recesses of the clamping sleeve in the radial direction on the one hand when the clamping sleeve is inserted into a respective retainer or retaining recess in a chisel holder. At the same time, the retaining projections should not protrude beyond the outer jacket surface of the clamping sleeve. On the other hand, the retaining projections are therefore dimensioned in the radial direction in such a way that they are non-protruding with respect to the outer jacket surface of the clamping sleeve when the clamping sleeve is inserted in the retainer, or do not protrude beyond said sleeve in the radial direction. The exterior outer jacket surface of the retaining ring thus preferably lies within the thickness of the clamping sleeve in the radial direction.

Finally, the present invention relates to a method for securing a round-shaft chisel in a chisel holder, especially comprising a round-shaft chisel arrangement according to the statements made above. Relevant steps of the method in accordance with one embodiment of the present invention are a) the clamping of the outer jacket surface of a clamping sleeve in the inner jacket surface of a receiving opening in a chisel holder for axially and rotationally securing the clamping sleeve with respect to the chisel holder, b) the engagement of retaining projections of a retaining ring in recesses of the clamping sleeve for axially securing the retaining ring with respect to the clamping sleeve, and c) the mounting (seating) of the retaining ring in an annular retaining groove arranged on the chisel shaft of a chisel for axially securing the chisel with respect to the retaining ring. The method in accordance with the present invention thus provides multistep securing of the round-shaft chisel in the axial direction in a suitable retainer of a chisel holder. In a first stage, the round-shaft chisel is secured with respect to the clamping sleeve by the engagement of the retaining projections of the retaining ring according to the preceding embodiments in the recesses of the clamping sleeve. A rotational bearing is obtained, however, between the retaining ring and the round-shaft chisel by the arrangement of the retaining ring in the circular retaining groove, which allows rotatability of the round-shaft chisel about its longitudinal and rotational axis with respect to the retaining ring and thus the clamping sleeve. Reference is hereby made to the aforementioned disclosure. The specific positioning of said entirety consisting of clamping sleeve, retaining ring and round-shaft chisel in the retainer of a chisel holder preferably occurs subsequently by frictional engagement of the clamping sleeve with respect to a suitable retaining recess in the chisel holder. There is consequently no direct clamping of the round-shaft chisel via the retaining ring or the clamping sleeve in said retainer. A respective transfer of retaining forces thus occurs via the steps a) between the retainer in the chisel holder and the clamping sleeve by a frictional engagement, b) the retaining ring is secured in an interlocking fashion in the clamping sleeve by radial engagement of the retaining projections in the recesses of the clamping sleeve, and c) the round-shaft chisel accommodates the retaining ring again with its retaining groove, as a result of which interlocking engagement is also ensured in the axial direction. At the same time, the round-shaft chisel is rotatably mounted about its longitudinal axis with respect to the retaining ring, so that in summary the round-shaft chisel is secured in the retainer of a suitable chisel holder against axial displacement and a rotation of the round-shaft chisel about its longitudinal axis is simultaneously possible in order to ensure uniform wear and tear of the chisel.

BRIEF DESCRIPTION OF THE DRAWINGS

The present invention will be explained below in closer detail by reference to an embodiment shown in the drawings, which show schematically:

FIG. 1 shows a perspective oblique view of a round-shaft chisel arrangement;

FIG. 2*a* shows a cross-sectional view along the longitudinal axis of the round-shaft chisel arrangement of FIG. 1;

FIG. 2*b* shows an enlarged view of a section of the region III of FIG. 2*a;*

FIG. 3 shows a cross-sectional view perpendicularly to the longitudinal axis of the round-shaft chisel arrangement of FIG. 1;

FIG. 4 shows a perspective oblique view of the retaining ring of FIGS. 1 to 3;

FIG. 5 shows a cross-sectional view along the longitudinal axis of the round-shaft chisel arrangement of FIG. 1 along the line II-II of Fig.; and FIG. 6 shows a cross-sectional view along the longitudinal axis of the round-shaft chisel arrangement of FIG. 1 along the line III-III of FIG. 3.

DETAILED DESCRIPTION OF THE INVENTION

The same components are labelled in the drawings with the same reference numerals, wherein not every component that is repeated in the drawings is mandatorily provided with a reference numeral in every figure.

FIG. 1 shows the relevant elements of a round-shaft chisel arrangement 1 in a perspective oblique view. In addition to the chisel 2, the round-shaft chisel arrangement 1 comprises a clamping sleeve 3, a retaining ring 4 and a wear disc 5. The chisel 2 is arranged in a rotation-symmetric way along the longitudinal axis L and comprises a chisel head 7 and a substantially cylindrical chisel shaft 8 in addition to the chisel tip 6. The sectional view in FIG. 2 along the longitudinal axis L shows, in particular, that the chisel 2 comprises an integral base body made of the same material, e.g., a steel base body, comprising the chisel head 7 and the chisel shaft 8, and a chisel tip 6 placed thereon. In the axial direction of the longitudinal axis L towards the chisel tip 6, the chisel head 7 protrudes in relation to the chisel shaft 8 in the radial direction and tapers towards the chisel tip.

A retaining groove 9 is present in the base body towards the chisel shaft end, which retaining groove represents an annular constriction with respect to the outer jacket surface 8' of the chisel shaft 8 and is used for accommodating the retaining ring 4 in the manner as will be described below in closer detail. The outer jacket surface 8' extends at a distance R3 around the longitudinal axis L, which is identical with the rotational axis of the chisel 2 in the round-shaft chisel arrangement 1. The base of the retaining groove 9 surrounds the longitudinal axis with a radius R1, which is smaller than the radius R3. Adjacent to the chisel head 7 is the annularly arranged wear disc 5, which, in the manner known from the prior art, is primarily used for wear protection of a retaining device for accommodating the round-shaft chisel arrangement 1.

A further relevant element of the round-shaft chisel arrangement 1 is the clamping sleeve 3, which is substantially formed in a hollow-cylindrical way. The clamping sleeve 3 thus comprises an outer jacket surface 10 with a radius R6 and an inner jacket surface 11 with a radius R4. The thickness DS of the clamping sleeve in the radial direction is indicated in FIG. 2*b* and is obtained from the difference between R6 and R4. Furthermore, the clamping sleeve 3 comprises a longitudinal recess 12 extending in the axial direction, so that the clamping sleeve 3 is not arranged circumferentially in the circumferential direction around the longitudinal axis L, but is arranged with an interruption by the recess 12. The recess 12 allows that the clamping sleeve 3 can be compressed, for example, to a limited extent and thus provides a clamping force for retaining the clamping sleeve 3 in a respective receiving borehole of a chisel holder. Said recess 12 is therefore also known as a clamping recess. The clamping sleeve 3 further comprises several recesses 13 (specifically four thereof) which are circularly arranged with even spacing in the circumferential direction around the longitudinal axis L, which is shown, in particular, by way of example, in the cross-sectional view according to FIG. 3 along the line I-I of FIG. 2. The recesses constitute pass-through openings in the clamping sleeve, which are arranged in an evenly distributed manner in the circumferential direction U in star form with respect to the longitudinal axis L. The recesses 13 have a height $H_1$ in the axial direction of the longitudinal axis L and a width $B_1$ (relating to the distance of the boundaries of the recesses 13 which are opposite of each other in the circumferential direction U.

The mechanical connection between the chisel 2 and the clamping sleeve 3 is primarily achieved by the retaining ring 4. It is shown in FIG. 4 in a perspective view. The retaining ring 4 primarily comprises an annular body 14 and retaining projections 16 which protrude to the outside beyond the outer circumferential surface 15 of the annular body 14 in the radial direction. They are arranged in a distributed manner at angular distances (which are specifically equal with respect to each other) around the longitudinal axis L on the annular body 14, so that the retaining projections 16 produce finger-like or lug-like projection elements which are respectively provided for engagement in one respective recess 13 of the clamping sleeve 3. Furthermore, a clamping recess 17 is also provided in the retaining ring 4, which clamping recess interrupts the circumference of the annular body 14 around the longitudinal axis L and thus provides a free clamping space, which allows the retaining ring 4 to be bent apart and compressed within limits. The annular body 14 is further provided with a bevel 19 towards the inner circumferential surface 18 and is arranged in a bevelled manner in this region towards an upper side 20. The bevel 19 extends with its surface in the cross-section along the longitudinal axis L at an angle $\alpha$ to the longitudinal axis, wherein said angle preferably lies in the range of 20° to 30°. The retaining projections 16 are arranged integrally with the annular body 14. They comprise a virtually flat face end 21 (exterior outer jacket surface of the retaining ring 4 and wall sections 22*a* and 22*b* on both sides in the circumferential direction U. They protrude approximately rectangularly at least in sections from the outer jacket surface 15 (the interior outer jacket surface of the retaining ring 4 of the annular body 14. The retaining projections 16 protrude with a height $RH_1$ in the radial direction R, which is obtained from the difference of the radius R5 of the exterior outer jacket surface 21 and the radius of the interior outer jacket surface 15. The retaining projections 16 have a width B2 in the circumferential direction U. The inner jacket surface 18 of the retaining ring 4 has a radius R2 with respect to the longitudinal axis L. The ratio in sizes of the radii R1 to R6 is stated in closer detail in FIG. 2*b* in the enlarged sectional view of the region III of FIG. 2*a*.

The retaining ring 4 is mounted in the retaining groove 9 of the chisel 2, as shown by way of example in FIGS. 2*a* and 3. The retaining groove 9 has a groove base 23 with the radius R1 and two groove walls 25*a* and 25*b* which limit the retaining groove 9 in and against the axial direction along the longitudinal axis L. The groove wall 25*b*, which is arranged towards the chisel shaft end, extends in a virtually flat manner in a plane perpendicularly to the longitudinal axis L. The groove wall 25*a* on the other hand, which is arranged towards the chisel tip, is formed in the longitudinal plane of intersection along the longitudinal axis L in a manner obliquely with respect to the longitudinal axis L, approximately at an angle corresponding to the angle $\alpha$ of the bevel 19. In summary, the retaining groove 9 is thus provided with a cross-sectional profile which expands in the radial direction, thus especially facilitating the mounting of the retaining ring 4 in the retaining groove 9. A free space 24 is present between the groove base 23 and the inner circumferential surface 18 of the annular body 14, so that the chisel 2 is rotatable about the longitudinal axis L with respect to the retaining ring 4. The extension of the free space 24 in the radial direction is obtained from the difference between R1 and R2. As a result, the retaining ring 4 thus does not rest on the groove base 23 within the retaining groove 9, so that the chisel 2 is rotatable around the longitudinal axis L with respect to the retaining ring 4. At the same time, the retaining ring 4 cannot be displaced along the longitudinal axis L beyond the side walls 25*a* and 25*b* of the retaining groove 9, wherein the retaining ring 4 lies with its outside circumference of its annular body within the outer circumference with the radius R3 of the chisel shaft 8.

When the clamping sleeve 3 is placed on the chisel shaft 8, the retaining projections 16 protrude in the radial direction beyond the jacket surface (R3) of the chisel shaft 8 and engage in the recesses 13 in the clamping sleeve 3 which respectively correspond to the respective retaining projections 16. Only one respective retaining projection 16 engages in each recess 13. As a result, the retaining ring 4 ensures shift protection of the chisel 2 with respect to the clamping sleeve 3 in the axial direction L because it strikes the groove walls 25*a* and 25*b* in and against the longitudinal axis L with its annular body 14 and prevents further movement by interlocking connection. At the same time, as a result of the retaining projections 16 engaging in the recesses 13, displacement in and against the axial direction L within a fixed margin is prevented by interlocking (form-locking) connection by the retaining projections 16 which strike the edges of the recesses 13. It is further relevant that, as shown, in particular, in FIGS. 2*a* and 3, the recesses 13 are dimensioned with larger size by a fixed amount in the axial direction L and in the circumferential direction U compared to the dimensions of the retaining projections 16 in these spatial directions. This allows a certain freedom of movement of the retaining ring 4 with respect to the clamping sleeve 3 within a fixed range, which especially facilitates mounting and dismounting of the clamping sleeve 3 with respect to the retaining ring 4. This is obtained, for example, from the different extensions H1 and H2 in the axial direction, so that the retaining projections 16 are provided with play by the differential amount H3 with respect to the recesses 13 with the height H1. The same applies to the widths B1 (width of the recess 13) and B2 (width of the retaining projections 16) in the circumferential direction U, wherein B1 is also arranged larger than B2 by a differential amount corresponding to the play. It is further relevant that the stop surfaces AF1 in the recess 13 of the clamping sleeve 3 and the stop surfaces AF2 on the retaining projections 16 extend perpendicularly with respect to the longitudinal axis L of the chisel (according to the cylinder axis of the clamping sleeve and the retaining ring), thus achieving an especially reliable securing by interlocking connection in the direction of the longitudinal axis L. The stop surfaces can also extend in an oblique manner, wherein maximum angles 13 greater 80° are ideal. If the angles decrease, however, there is an increasing risk that the stop surfaces act as sliding bevels in the case of tensile loading of the chisel. This arrangement of the stop surfaces AF1 and AF2 is especially relevant with respect to the stop surfaces of the clamping sleeve 3 and the retaining projections 16 which face the chisel head 7 in the direction of the longitudinal axis L.

FIGS. 2*a*, 2*b* and 3 illustrate further that the retaining projections are dimensioned in the radial direction in such a way that they do not protrude in the radial direction beyond the outer jacket surface 26 of the clamping sleeve 3 in the state engaging in the recesses 13 of the clamping sleeve 3. In other words, the retaining projections 16 are non-protruding or free from protrusion with respect to the outer jacket surface 10 of the clamping sleeve 3. The dimensioning of the retaining projections 16 in the radial direction thus occurs in the manner that they lie within the thickness $D_S$ of the clamping sleeve 3 with their face end 21 situated on the outside in the radial direction. As a result, the engagement of the retaining projections 16 in the recesses 13 which comes from the inside is ensured on the one hand and the retaining projections 16 do not represent a obstruction to displacement to the outside of the clamping sleeve on the other hand.

In summary, the present embodiment of the round-shaft chisel arrangement 1 thus provides an efficient rotational bearing around the longitudinal axis L for the round-shaft chisel 2 in the round-shaft chisel arrangement 1. At the same time, reliable axial securing of the chisel 2 by the retaining ring 4 with respect to the clamping sleeve 3 is provided, which clamping sleeve is held in a frictionally engaged manner in a suitable retainer in a chisel holder (not shown). This special embodiment of the round-shaft chisel arrangement 1 minimises the required freedom of movement in the radial direction between the chisel shaft 8 and the inner jacket surface 11 of the clamping sleeve 3, so that the free space for the milled material penetrating this region from the outside is extremely small.

FIGS. 5 and 6 illustrate the functionality of the round-shaft chisel arrangement 1 in the state installed in a chisel holder 27. The chisel holder 27 has a substantially hollow-cylindrical receiving channel 28, into which the round-shaft chisel arrangement 1 is inserted. The receiving channel 28 is provided with an open configuration both towards the chisel tip and also on the rear side to the outside. Milling material was especially introduced up until now into the region of the clamping sleeve 3 by the rear opening acting as a rinsing opening. FIG. 5 illustrates the extension of the retaining projections 16 in the radial direction into the recesses 12 of the clamping sleeve, but not beyond the outer jacket surface of the clamping sleeve 3. The sectional view along the line III-III according to FIG. 6, which extends outside of the retaining projections 16, illustrates in comparison that the retaining ring is surrounded by the clamping sleeve 3 outside of the retaining projections. In both regions, the retaining ring 3 further protrudes with its inner jacket into the retaining groove 9 and is thus secured in the region of the two groove walls in the axial direction of the rotational axis. FIGS. 5 and 6 thus generally indicate that the round-shaft chisel is rotatably axially secured with respect to the clamping sleeve 3 by the retaining ring 4. The retaining of this unit in the chisel holder 27 occurs via the clamping sleeve 3 which rests in a flat manner on the inner wall of the receiving channel 28.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of Applicants' invention.

What is claimed is:

1. A round-shaft chisel arrangement having a longitudinal axis (L), comprising:

a) a chisel with a chisel shaft and a chisel tip, wherein a retaining groove, which surrounds a circumference of the chisel shaft, is present in the chisel shaft;

b) a clamping sleeve which surrounds the chisel shaft at least in part; and c) a retaining ring which engages around the chisel shaft in the retaining groove at least in part and comprises at least two retaining projections which are oriented radially to an outside of the retaining ring, wherein the retaining projections protrude radially beyond an outer jacket surface of the chisel shaft and engage in corresponding recesses in the clamping sleeve, and further wherein the recesses are pass-through openings passing through the clamping sleeve and are thus provided with an open configuration towards an exterior side and an interior side of the clamping sleeve.

2. The round-shaft chisel arrangement according to claim 1, wherein the retaining ring comprises an annular body on which the retaining projections are circumferentially arranged so as to protrude beyond an outside circumference of the annular body in a radial direction, wherein the annular body is arranged such that the outside circumference of the annular body does not protrude beyond the outer circumferential surface of the chisel shaft.

3. The round-shaft chisel arrangement according to claim 2, wherein a thickness of the retaining projections in an axial direction is equal to a thickness of the annular body in the axial direction.

4. The round-shaft chisel arrangement according to claim 1, wherein the retaining ring consists of spring steel.

5. The round-shaft chisel arrangement according to claim 1, wherein a radial extension of the retaining projections is dimensioned in such a way that, in engagement in the recesses of the clamping sleeve, the retaining projections do not protrude in the radial direction beyond an outer jacket surface of the clamping sleeve.

6. The round-shaft chisel arrangement according to claim 1, wherein the retaining ring comprises a bevel towards its inner circumferential surface.

7. The round-shaft chisel arrangement according to claim 1, wherein the recesses in the clamping sleeve are dimensioned in an axial direction or in a circumferential direction in such a way that the retaining projections have play with respect to the recesses.

8. A method for securing a round-shaft chisel arrangement according to claim 1 in a chisel holder, comprising the following steps:

a) mounting the retaining ring in the annular retaining groove arranged on the chisel shaft of the chisel for axially securing the chisel against the retaining ring;

b) engaging the retaining projections of the retaining ring in the recesses of the clamping sleeve for axially securing the retaining ring against the clamping sleeve; and c) clamping an outer jacket surface of the clamping sleeve on an inner jacket surface of a receiving opening in a chisel holder for axially and rotationally securing the clamping sleeve against the chisel holder.

* * * * *